United States Patent [19]

Brandt

[11] 4,074,426

[45] Feb. 21, 1978

[54] THREADED BLADE HOLDER

[76] Inventor: Michael W. Brandt, 1111 W. Mockingbird, Dallas, Tex. 75247

[21] Appl. No.: 717,092

[22] Filed: Aug. 24, 1976

[51] Int. Cl.[2] ..... B67B 7/00; B67B 7/44

[52] U.S. Cl. ..... 30/1.5; 30/130; 81/3.1 B

[58] Field of Search ..... 30/1.5, 130, 435, 442; 81/3.1 B, 3.49

[56] References Cited

U.S. PATENT DOCUMENTS

| | | | |
|---|---|---|---|
| 1,048,202 | 12/1912 | Oberg | 30/435 X |
| 2,176,714 | 10/1939 | Hoppenstand | 30/442 X |
| 2,496,672 | 2/1950 | Newman | 81/3.49 X |
| 3,581,605 | 6/1971 | Taylor | 81/3.49 |

FOREIGN PATENT DOCUMENTS

| | | | |
|---|---|---|---|
| 1,048,219 | 12/1953 | France | 30/435 |

*Primary Examiner*—James L. Jones, Jr.
*Assistant Examiner*—James G. Smith
*Attorney, Agent, or Firm*—Howard E. Moore; Gerald G. Crutsinger; Larry B. Dwight

[57] ABSTRACT

A threaded blade holder for cutting an opening in a flexible externally threaded closure element on a pail or container. The holder comprises a hollow internally threaded tubular body. A retaining member, comprising a pointed spike, is slideably disposed in a central aperture in the top of the tubular body to perforate the closure element and to relieve internal pressure in the pail through space between loosely fitting threads on the blade holder and the closure element. A pointed cutting blade, having a single cutting edge, extends downwardly from the top of the tubular body such that rotation of the tubular body onto the externally threaded closure element of the pail causes the blade to engage the upper surface of the closure element to cut a circular hole therein. However, the blade does not cut into material adjacent the periphery of the hole when the tubular element is removed from the externally threaded closure element. The retaining member, extending through the circular diaphragm portion of the closure element that has been cut out of the end of the closure element, prevents contamination of contents of the pail since the severed diaphragm is retained inside the tubular body.

11 Claims, 14 Drawing Figures

THREADED BLADE HOLDER

BACKGROUND

Liquid material such as medical liquids, cleaners, printing ink, pesticides and other chemicals are often stored in pails constructed of metal, plastic, or fiber. Often these pails have a flexible closure element such as the ones referred to as "Flexspot" manufacturing by Rieke Corporation of Auburn, Indiana which afford a directional pour spout which is collapsible for easy stacking of the pails.

These flexible closure elements come sealed from the factory and the diaphram must be removed from the outer end of the closure element or spout for dispensing liquid materials contained in the pail. Heretofore, the flexible closure elements have been pulled upwardly through an opening formed in the upper surface of the pail to provide access to the upper diaphram surface on the closure element and a knife, screwdriver, or other instrument was used to cut the diaphram from the end of the closure element.

Use of a knife to open a flexible closure often results in a jagged, uneven cut across the upper end of the closure element. This jagged, uneven cut prevents proper resealing of the spout by the cap furnished with the closure element. In addition, the jagged edge does not afford proper directional flow of liquid contained in the pail when the liquid is poured through the dispensing spout.

In addition internal pressure sometimes develops in the pail due to thermal expansion of the chemicals ccontained therein. Cutting of the closure element with a knife or similar instrument may result in spraying vapor and scattering contents of the container which may be hazardous to the person opening the container or persons in the surrounding area.

Heretofore, devices have been devised which were intended to open membrane-sealed plastic bottles. Such devices are disclosed in U.S. Pat. Nos. 3,402,855; 3,581,605; and 3,784,045.

Devices of the type disclosed in the aforementioned patents employed cutting blades of various configurations which failed to efficiently cut a smooth edged circular opening in membrane-sealed closure elements constructed of readily deformable plastic material. One of the devices employed a cylindrical cutting blade having a sharpened lower surface such that the lower extremity of the cutting blade contacted the upper surface of the closure element around the entire lower periphery of the cutting blade. Another of the devices employed a cylindrical cutting blade having a serrated lower edge, each of the serrations being sharpened on each edge of the triangular shaped serrations to form cutting edges. Another of the devices employed a plurality of diametrically opposed cutting blades having cutting edges on the leading and trailing edges of each of the blades.

Difficulty has been experienced in screwing devices having cylindrical and multiple blades onto a flexible externally threaded pour spout for severing the diaphram across the end of the pour spout without stripping threads on the exterior surface of the relatively soft flexible material. Further, difficulty has been encountered in the use of such perforating devices wherein cutting edges were provided on both the leading edge and the trailing edge of the cutting blade since the trailing edge of the cutting blade tended to cut into the periphery of the opening formed in the membrane upon removal of the blade holding device from the externally threaded closure element.

It should further be noted that U.S. Pat. No. 3,581,605 discloses a combined membrane piercing and extracting member mounted to retain the diaphram portion of the closure element which has been cut away in the cap. However, the membrane extracting member was rigidly secured to the cap member such that it was difficult to remove severed membrane members from the cap making the device impractical for reuse in opening containers of toxic chemical because of the danger that the user might contact the chemical.

SUMMARY OF INVENTION

I have devised a threaded blade holder for cutting a smooth edged circular opening through the upper diaphram surface of a flexible closure element or pour spout on a pail or container. The device comprises a hollow tubular body having a top formed thereon through which a central aperture extends. A retaining element, such as a pointed spike, is slideably disposed through the central aperture formed in the top of the tubular body of the blade holder.

A narrow, thin, flat blade, having a single sharpened cutting edge, extends downwardly from the top of the body such that the blade engages the upper surface of the closure element at a single point after threads on the body of the blade holder have engaged the threads on the outer surface of the closure element. The retaining element is driven through the aperture in the top of the tubular body of the blade holder and through the diaphram on the end of the closure element.

As the body of the blade holder is further rotated, the blade travels in a circular path cutting through the surface of the closure element. A circular opening is cut by the blade into the closure element.

The severed circular portion of the diaphram, impaled upon the pointed retaining element, is retained in the body portion of the blade holder when the body is unscrewed from the closure element.

After the blade holder has been removed from the closure element, the retaining member is retracted or withdrawn from the aperture in the blade holder thereby releasing the severed diaphram.

The blade holder, having loosely fitting threads, deflects any liquid or vapor spray forced from the pail by internal pressure when the retaining element or the cutting blade ruptures the diaphram portion of the closure element.

A primary object of the invention is to provide a threaded blade holder which is adapted to form a uniform, smooth, non-drip edge on the upper surface of a flexible pour spout or closure element such that the spout is capable of being resealed by a cap.

Another object of the invention is to provide a blade holder having a blade mounted therein, the blade having a cutting edge only on the leading edge thereof to prevent cutting and roughening surfaces adjacent the periphery of an aperture upon removal of the blade holder from a closure element.

Another object of the invention is to provide a blade holder in combination with a diaphram retaining element adapted to retain the severed portion of a diaphram within the blade holder to prevent the severed diaphram from falling into the container and further adapted to eject the severed diaphram from the blade holder after the blade holder has been disconnected from the previously sealed closure element.

A still further object of the invention is to provide a blade holder having an improved cutting blade detachably secured thereto such that the blade can be expeditiously replaced when the cutting edge has been dulled.

Other and further objects of the invention become apparent upon referring to the detailed description hereinafter following and to the drawings annexed hereto.

DESCRIPTION OF DRAWING

Drawings of a preferred embodiment of the invention are annexed hereto so that the invention may be better and more fully understood, in which.

Numeral references are employed to designate like parts throughout the various figures of the drawings.

DESCRIPTION OF A PREFERRED EMBODIMENT

Figure 1:
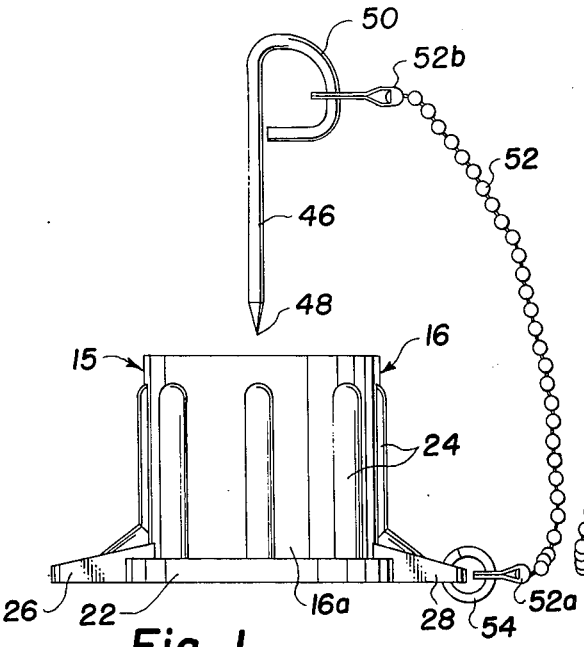
FIG. 1 is a front elevational view of the threaded blade holder.
Figure 2:
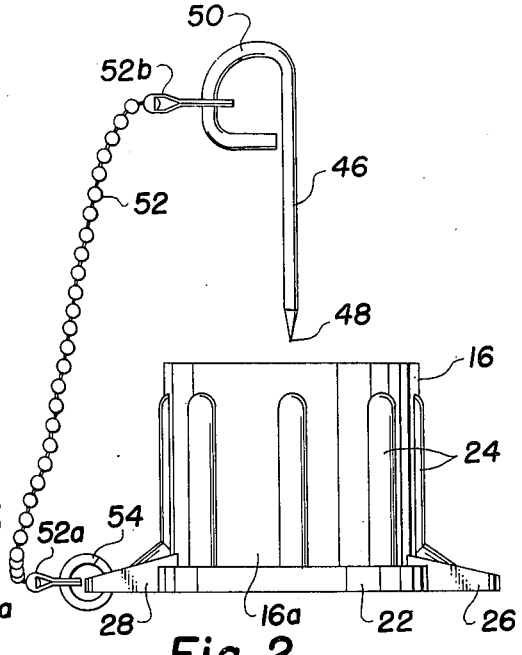
FIG. 2 is a rear elevational view thereof.
Figure 3:
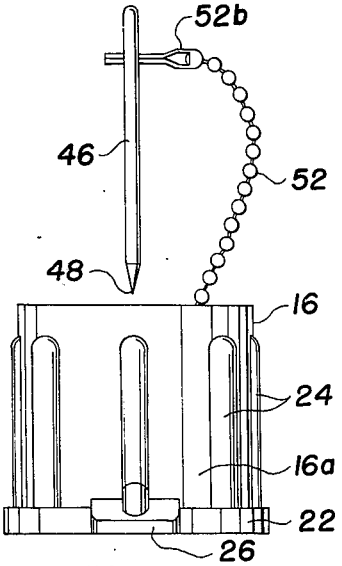
FIG. 3 is a left side elevational view thereof.
Figure 4:
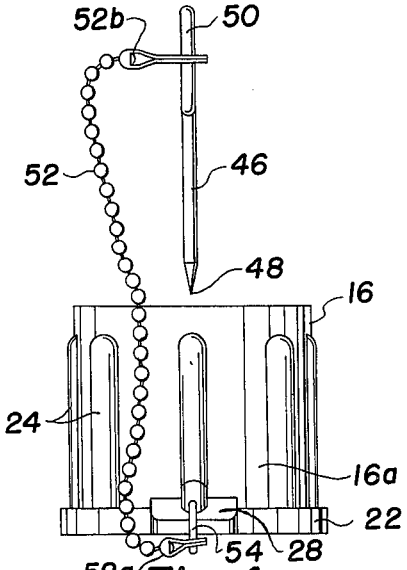
FIG. 4 is a right side elevational view thereof.

Referring to FIGS. 1–7 of the drawing, the numeral 15 generally designates the threaded blade holder comprising a cylindrical body 16 having a smooth wall socket 17 formed in the upper end thereof, a threaded bore 18 formed in the lower end thereof, and a top 20 separating the socket 17 and threaded bore 18. An annular flange 22 extends about the lower end 16*a* of body 16 to provide structural rigidity and to facilitate gripping and rotating the cylindrical body 16.

The exterior surface of body 16 has gripping lugs or ridges 24 formed thereon to roughen the exterior surface of body 16 to aid in attaching the body 16 to pour spout 65, as will be hereinafter more fully explained.

The body 16 is preferably injection molded to form a single unit of rigid material, such as hard plastic or metal.

For removal of temporary covers or seals which are generally placed over collapsed pour spouts 65, tapered pry-bars 26 and 28 extend outwardly from opposite sides of annular flange 22 on the lower end 16*a* of body 16 to provide a hand bar for prying off seals as will be hereinafter more explained.

Figure 5:
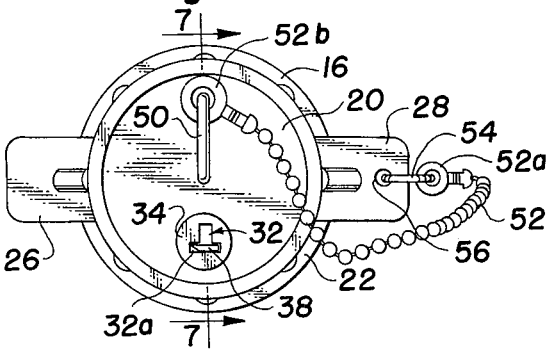
FIG. 5 is a top plan view thereof.
Figure 6:
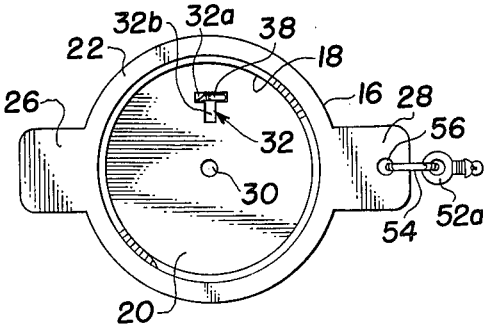
FIG. 6 is a bottom view thereof.
Figure 8:
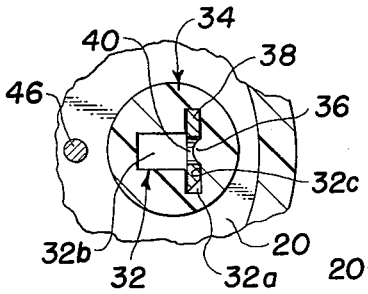
FIG. 8 is an enlarged cross-sectional view taken along line 8—8 of FIG. 7.

The top 20, extending perpendicular to the central axis of cylindrical body 16, has a central aperture 30 formed therethrough. As best illustrated in FIGS. 5 and 8 of the drawings, a circular plug 34 extends upwardly from the upper surface of top 20 and has an opening 32 extending therethrough.

Opening 32 is preferably T-shaped and comprises intersecting legs or elongated portions 32*a* and 32*b*. As will be hereinafter more fully explained, the T-shaped configuration of opening 32 causes the central portion of blade 38 to flex slightly to facilitate insertion of the blade.

The elongated portion 32*a* of opening 32 extends perpendicular to the radius of socket 17 and is radially inwardly from the wall 19 of threaded bore 18.

A detent 36 extends into the elongated portion 32*a* of opening 32 from a central portion of the outer wall 32*c* of the elongated portion 32*a* of opening 32.

Referring to FIGS. 7–14, cutting blade 38 has an aperture 40 formed therein. As blade 38 is urged downwardly through the elongated portion 32*a* of opening 32, the detent 36 on the outer wall 32*c* urges the central portion of blade 38 into the elongated portion 32*a* of opening 32. When detent 36 and aperture 40 become aligned, blade 38 returns to a flat configuration and is detachably secured in the elongated portion 32*a* of opening 32.

As best illustrated in FIGS. 9–14, blade 38 comprises a thin, narrow blade having cutting edge 42 extending vertically along one side and having a lower end on the opposite side cut away to form a point 44. It should be appreciated that point 44 is formed by tapered edge 45 which is not sharpened.

It should be readily apparent that the point 44 on blade 38, when detent 36 is positioned in aperture 40, extends downwardly through the elongated portion 32*a* of passage 32 and that the cutting edge 42 is arranged to cut through the upper diaphram portion 70 closing the upper end of pour spout 65.

A membrane retaining member such as spike 46 having a pointed lower end 48 and a loop 50 formed on the opposite end thereof is slideably disposed through aperture 30 formed in the top 20 which extends transversely across a central portion of cylindrical body member 16.

Chain 52 has a first end 52*a* secured to a ring 54 which extends through an aperture 56 formed in pry-bar 28 and a second end 52*b* secured to the loop 50 formed in the end of membrane retaining member 46. It should be appreciated that membrane retaining member 46 is movably secured to the cylindrical body 16 and is slideably disposed through the central passage 30 formed in the top 20 of cylindrical member 16.

Figure 7:
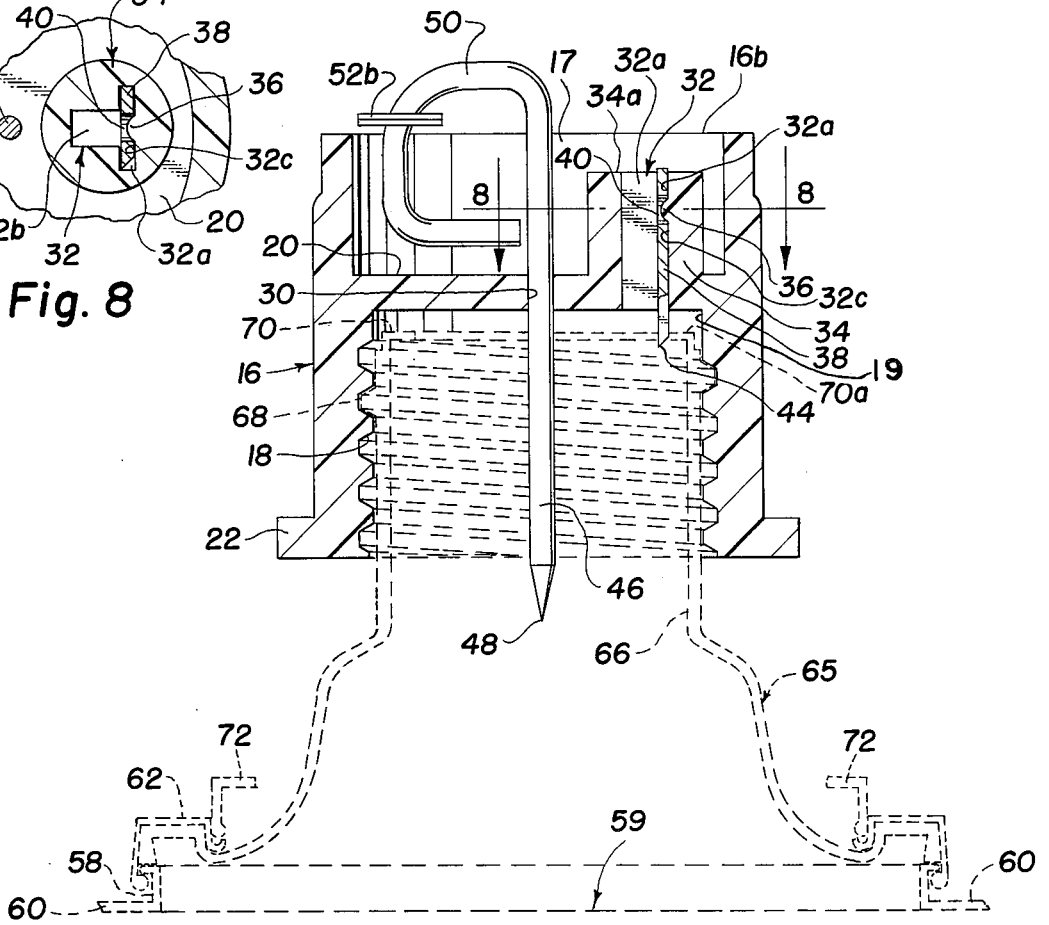
FIG. 7 is a cross-sectional view taken along line 7—7 of FIG. 5 showing the threaded blade holder attached to a flexible pour spout.
Figure 9:
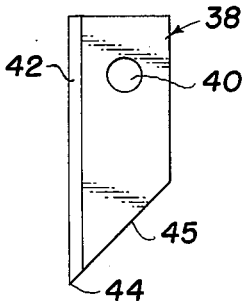
FIG. 9 is a front elevational view of the blade.
Figure 10:
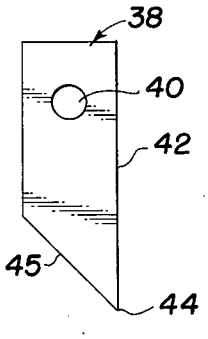
FIG. 10 is a rear elevational view thereof.
Figure 11:
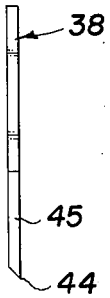
FIG. 11 is a right side elevational view thereof.
Figure 12:
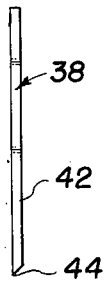
FIG. 12 is a left side elevational view thereof.
Figure 13:
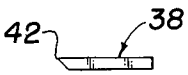
FIG. 13 is a top plan view thereof.
Figure 14:
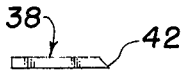
FIG. 14 is a bottom elevational view thereof.

A conventional flexible pour spout closure 65 is illustrated in dashed outlined in FIG. 7 of the drawing. The pour spout 65 is of the type manufactured by Rieke Corporation of Auburn, Indiana, and sold under the registered trademark "Flexspout".

Spout 65 is adapted to fit over flange 58 which is formed about an opening 59 on the top or upper surface of pail or container 60, also illustrated in dashed outline.

It should be noted that the point 44 on the lower end of cutting blade 38 extends downwardly into the threaded bore 18 from the lower surface of top 20 a distance substantially equal to the distance from the upper end 34*a* of cylindrical plug 34 to the upper end 16*b* of cylindrical member 16. Thus, if detent 36 becomes disengaged from aperture 40 in blade 38 while the threaded blade holder is in use, the upper end of blade 38 would become substantially aligned with the upper end 16*b* of cylindrical member 16 thereby preventing injury to the hand of a person using the blade holder.

OPERATION

The operation and function of the apparatus hereinbefore described is as follows:

Referring to FIG. 7 of the drawing, the pour spout 65, illustrated in dashed outline, is initially collapsed into the container 60 such that the upper end 70 is at an elevation substantially equal to that of the upper surface of annular retaining ring 62 and a circular seal or closure member 72 is secured to retaining ring 62 completely concealing pour spout 65.

Pray-bar 26 on the lower end of threaded blade holder 15 is employed for removing seal member 72 from annular retaining ring 62. The flexible spout 65 is then pulled upwardly to the position illustrated in dashed outline in FIG. 7 of the drawing.

Such spouts are generally provided with a cap threadedly secured to the upper end of spout 65. The cap (not shown) is removed from spout 65.

Body 16 is then positioned on the upper threaded end 68 of spout 65 and is rotated to start body 16 on the threads on the spout. The membrane retaining spike 46 is then moved downwardly through aperture 30 in the top 20 of the threaded blade holder 15 and is urged through membrane 70 closing the upper end of spout 65.

It should be appreciated that if container 60 is internally pressurized, the pressure is relieved through the opening formed by pointed end of membrane retaining spike 46. Any pressurized vapor escaping from container 60 will be deflected downwardly through space between the inner wall 19 of the threaded bore 18 and the outer surface of spout 65 and consequently generally in a direction away from the user of the threaded blade holder.

The body 16 is then further rotated onto the threaded end 68 and moved downwardly on spout 65 until the point 44 on blade 38 engages the upper surface of sealing membrane 70.

Blade 38, being positioned perpendicular to the radius of threaded bore 18, forms a circular opening since blade 38 moves along a circular path as blade holder 15 moves downwardly onto spout 65.

Removal of the blade holder 15 from pour spout 65 is accomplished by rotating cylindrical body 16 in a counterclockwise direction. It is important to note that since blade 38 has a sharpened cutting edge only on the leading edge 42, the blade will not cut or roughen the periphery of the opening formed in membrane 70 as the blade holder 15 is disconnected from the upper end of pour spout 65.

It should also be noted that since blade 38 is spaced radially inwardly from the inner wall 66 of spout 65, a flat inwardly extending annular shoulder 78 extends about the periphery of the opening formed in the diaphram 70 on the end of pour spout 65.

After the blade holder 15 has been removed from the end of pour spout 65, the disc-shaped severed portion of the diaphram remains impaled upon the spike 46 and concealed inside the threaded bore 18 in blade holder 15. As the threaded spike 46 is moved upwardly through aperture 30 in the top 20 in blade holder 15, the severed diaphram is moved off of the lower end of spike 46 and falls from the bore 18 thereby ejecting the severed portion of the diaphram from the blade holder.

In view of the fact that pour spout 65 is often constructed of a very soft, flexible or pliable material, it is important that the point 44 on the end of blade 38 be very sharp such that it will penetrate diaphram 70 upon application of a relatively small force to prevent stripping threads from the outer surface of spout 65. The tapered rear edge 45 on blade 38 is preferably inclined at an angle of approximately 34° and substantially intersects the flat lower surface of top 20 such that the blade does not roughen the smooth surface formed by the sharp cutting edge and to minimize probability that any burrs which might be present about the periphery of the opening formed in the diaphram 70 will be removed to drop into container 60.

In view of the foregoing it should be readily apparent that the apparatus hereinbefore described accomplishes the objects of the invention hereinbefore discussed.

It should be appreciated that other and further embodiments of the invention may be devised without departing from the basic concept thereof.

Having described my invention, I claim:

1. A blade holder comprising: a body, said body having an internally threaded hollow bore formed therein; a top on the body extending across one end of the bore, said top having a T-shaped blade receiving opening extending therethrough; a flat pointed cutting blade having a single cutting edge; and means in said T-shaped opening detachably securing said cutting blade to the top of the body such that the cutting blade extends downwardly into the bore in the body.

2. The blade holder called for in claim 1, with the addition of: pointed retaining means slidably secured to the top of the body and axially aligned with a central axis of the bore.

3. The blade holder called for in claim 1 wherein the body has a pry-bar formed on the lower exterior edge thereof.

4. A threaded blade holder to support a blade to cut an opening in an externally threaded flexible spout on a container comprising: a hollow cylindrical body having a threaded bore; a top formed across the upper end of said bore, the top having an elongated opening extending therethrough, said elongated opening being spaced outwardly from a central axis of said bore; a cutting blade having a pointed end and a single cutting edge; means to secure said cutting blade in said elongated opening such that as the body is threadedly secured to the spout, the cutting blade pierces the upper surface of the spout and as the body is rotated the blade cuts a circular opening in the upper end of the spout.

5. The blade holder called for in claim 4, the top having an aperture extending through the center thereof; a retaining member adapted to be slideably disposed through the aperture in the top to pierce the center of the top end of the spout to retain the central portion of the spout which is cut out by the blade; and means moveably securing said retaining member to said body.

6. The blade holder called for in claim 4 with the addition of: a pry-bar formed on the lower edge of the body such that it extends outwardly from the outer periphery of the body.

7. The blade holder called for in claim 4 wherein the means to secure the cutting blade in the elongated opening comprises: a detent extending into said elongated opening, said cutting blade having a passage formed therein, said elongated opening being shaped such that said blade is restrained against longitudinal movement when the detent and the passage in the blade are aligned.

8. The blade holder called for in claim 4 wherein the cutting blade comprises: a steel blade having a single cutting edge and an edge on said blade tapered upwardly away from the single cutting edge such that a point is formed on the lower portion of the cutting edge of the blade.

9. The blade holder called for in claim 5 wherein the retaining member comprises: a pointed spike.

10. The blade holder called for in claim 4 with the addition of: gripping lugs on the exterior surface of the cylindrical body.

11. A blade holder adapted to cut a circular opening in an externally threaded flexible spout, the holder comprising: a body having an internally threaded bore in a lower end thereof and having a socket formed in an upper end thereof; a partition on said body separating said internally threaded bore from said socket, said partition having a blade receiving opening formed therein; and means in said opening to secure a cutting blade in the opening such that the blade extends downwardly into the internally threaded bore a distance which is substantially equal to the distance between the upper end of the blade and the upper end of the body such that the upper end of the blade will not injure the hand of a user if the blade moves upwardly through the opening in the partition while the blade holder is being screwed onto an externally threaded neck.

* * * * *